United States Patent [19]

Arimatsu

[11] 4,103,839

[45] Aug. 1, 1978

[54] APPARATUS FOR WINDING CUT BELT-LIKE MATERIAL

[76] Inventor: Tadayoshi Arimatsu, No. 470, Ibatahama-cho, Turumi-ku, Osaka-shi, Osaka-fu, Japan

[21] Appl. No.: 786,861

[22] Filed: Apr. 12, 1977

[51] Int. Cl.[2] ..... B65H 35/02

[52] U.S. Cl. ..... 242/56.2; 242/75.2

[58] Field of Search ..... 242/56.2, 75.2; 226/39, 226/195

[56] References Cited

U.S. PATENT DOCUMENTS

| | | | |
|---|---|---|---|
| 2,275,093 | 3/1942 | Spangler | 242/75.2 X |
| 3,285,484 | 11/1966 | Johnson | 226/195 X |
| 3,386,679 | 6/1968 | Foulon | 242/56.2 |
| 3,771,738 | 11/1973 | Abbey | 242/25.2 |

*Primary Examiner*—Edward J. McCarthy

*Attorney, Agent, or Firm*—George B. Oujevolk

[57] ABSTRACT

The invention relates to an apparatus for winding cut beltlike material, the winding apparatus comprising a beltlike material travel adjusting mechanism coordinated with the travel of the cut beltlike material, cutters for cutting the beltlike material and a winding spindle, the beltlike material travel adjusting mechanism comprising rollers, conveyors and elastic projections mounted on said rollers and conveyors.

2 Claims, 4 Drawing Figures

APPARATUS FOR WINDING CUT BELT-LIKE MATERIAL

The invention relates to an apparatus for winding cut beltlike material. Particularly, a steel sheet cut in a predetermined width, for example, a sheet has a thickness progressively decreasing from the center toward both sides, though to an infinitesimal degree. Consequently, the winding diameter of the cut beltlike material is slightly smaller at both sides as compared with that of the center thereof giving rise to a difference in the peripheral speed, as a result of which a slack arises at both sides of the beltlike material according as it is taken up. The longer the length of the beltlike material, the greater the amount of the slack so that uniform winding is unfeasible. The invention relates to a winding apparatus enabling to wind beltlike material uniformly with utmost simplicity.

A first object of the invention is to provide a cut beltlike material winding apparatus which will obviate a slack otherwise arising in the course of winding cut beltlike material. This is particularly important since it makes it possible to transport or store cut beltlike material without damage and loss of the commercial value.

A second object of the invention is to provide a winding apparatus which makes it possible to wind cut beltlike material automatically and with efficiency, to say nothing of the convenience in handling.

A third object of the invention, the last but not the least important, is to provide a cut beltlike material winding apparatus comprising a cut beltlike material travel adjusting mechanism which can adjust the slack by detecting irregularities of the travel of the cut beltlike material.

These and other objects are accomplished by the construction and operation described in detail hereinunder in reference to the accompanying drawings.

Figure 1:
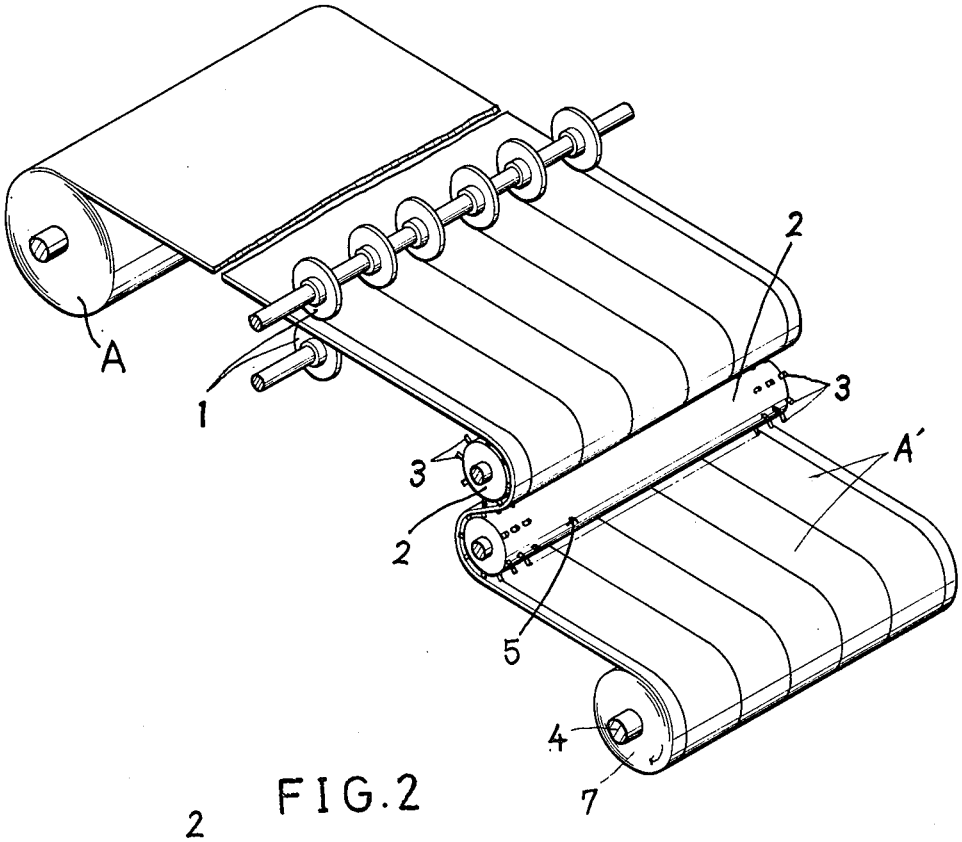
FIG. 1 is a perspective view of the principal part of a winding apparatus shown as a preferred embodiment of the invention.
Figure 2:
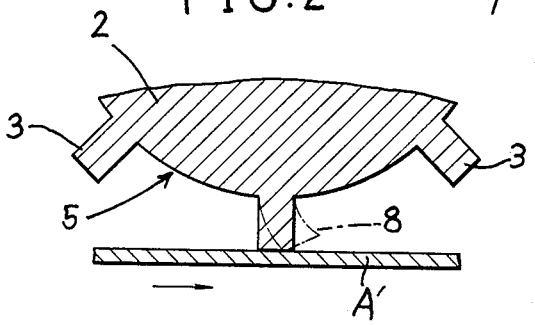
FIG. 2 is a theoretical view of how a longitudinal sectional side elevation, on a magnified scale, of one part of FIG. 1 might appear.

Referring to FIGS. 1 and 2, (A) designates beltlike material consisting of a steel sheet wound in a roll, the beltlike material (A) being adapted to travel between a multiplicity of upper and lower cutters 1 provided in pairs and disposed in juxtaposition respectively, whereby the beltlike material (A) is cut into parallel beltlike material (A') of a predetermined width respectively.

The numeral 2 designates upper and lower rollers adapted to permit the cut beltlike material (A') to travel therebetween, 3 designating projections provided on the surfaces of the rollers 2 in an optional arrangement, the projections 3 being made of elastic material, such as rubber and the like, capable of bending and regaining its original state. The rollers 2 and the projections 3 constitute a beltlike material travel adjusting mechanism 5. The projections 3 may be planted directly in the rubber rollers 2 or mounted on rubber films provided on the outer peripheries of metal rollers 2. The numeral 4 designates a winding take-up spindle for winding the cut beltlike material (A'), 7 designating a wound pay-off roll of the cut beltlike material (A').

The operation of the apparatus according to the invention is as follows. The beltlike material (A) is caused to travel between the cutters 1 in order to obtain cut beltlike material (A'). The cut beltlike material (A') is fed forwardly by means of the rollers 2 brought into contact with both surfaces thereof, subsequently the respective strips of the cut beltlike material (A') being wound in parallel on the winding spindle 4. Since the thickness of the beltlike material (A) slightly decreases from its center toward both sides thereof, the winding diameter of the cut beltlike material (A') is correspondingly reduced toward both sides of the winding spindle 4 resulting in a difference in the peripheral speed. According to the invention, however, both sides of the cut beltlike material (A') are adapted to travel at a speed equal to that of the rollers 2, the central part of the cut beltlike material (A') travelling at a slightly higher speed relative to both sides thereof.

The projections 3 brought into contact with the central part of the cut beltlike material (A') are subjected to bending 8 as shown by chain lines in FIG. 2 after moving in the direction of the travel of the cut beltlike material (A'). When the bending 8 of the projections 3 reaches a maximum, the central part of the beltlike material (A') slips on the projections 3. Thus brakes are applied to the central part of the beltlike material (A') thereby permitting the projections 3 to be restored from the bending 8 thereof.

As described hereinbefore, the cut beltlike material (A') is wound on the winding spindle 4 without a slack. Since the projections 3 are provided on the outer peripheries of the rollers 2, they are capable of detecting unbalanced travel of the cut beltlike material (A') at any position of the rollers 2 and adjusting such unbalance by means of the bends 8 thereof.

Figure 3:
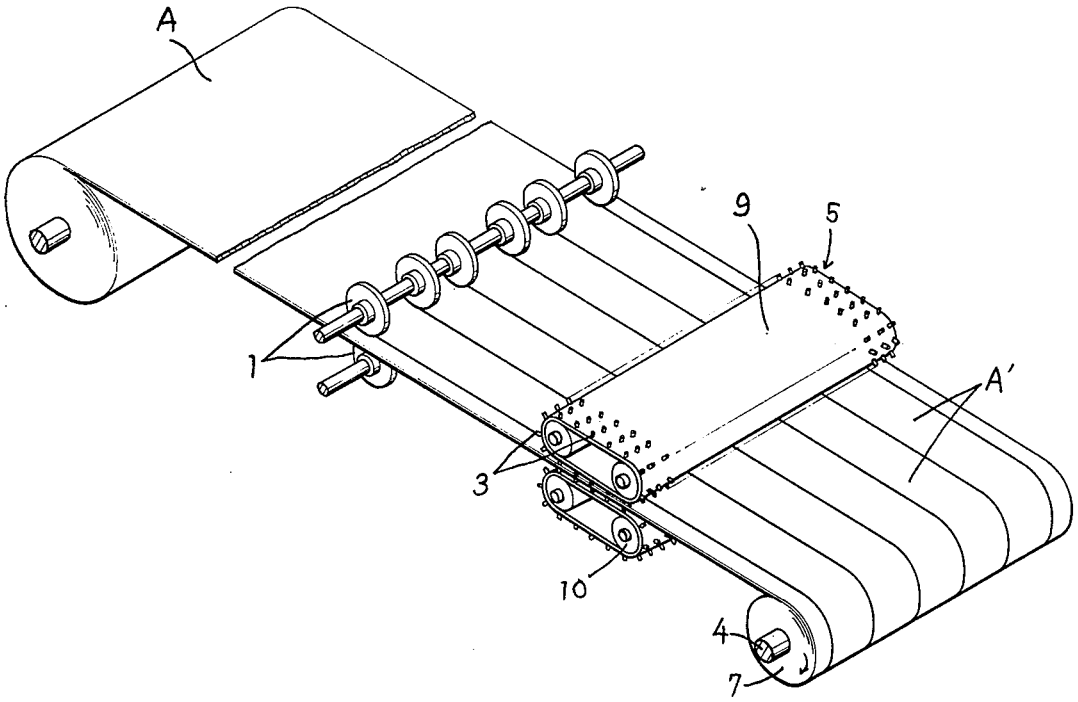
FIG. 3 is a perspective view of the principal part of a winding apparatus shown as another embodiment of the invention.

Another embodiment of the invention will now be described in reference to FIGS. 3 and 4. The constructional difference consists in the fact that the projections 3 are provided on the surfaces of conveyors 9. At least two pulleys 10 are provided in order to sustain the respective conveyors 9, the upper and lower conveyors 9 being disposed so as to vertically coincide with each other. The projections 3 are provided on the surface of each conveyor 9 in an optional arrangement, the projections 3 being made of elastic material, such as rubber and the like, capable of being bent and restored to the original state. The conveyors 9 are adapted to travel at a speed equal to that of both sides of the cut beltlike material (A') thereby precluding the occurrence of a winding slack.

As already mentioned, since the beltlike material (A) is thinner, though infinitesimally, toward both sides thereof, the winding diameter of the cut beltlike material (A') is smaller at both sides relative to the central part thereof resulting in a difference in the peripheral speed. According to the invention, however, the speed of the cut beltlike material (A') at both sides thereof is adapted to be equal to that of the conveyors 9, as a result of which the speed of the central part of the beltlike material (A') is appreciably greater than that of both sides thereof.

Figure 4:
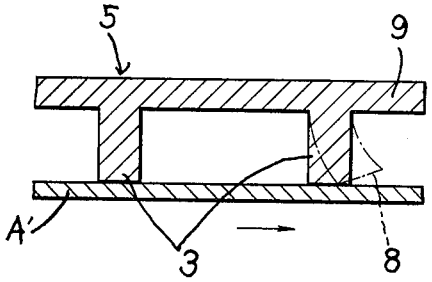
FIG. 4 is a theoretical view of how a longitudinal sectional side elevation, on a magnified scale, of one part of FIG. 3 might appear.

The projections 3 brought into contact with the central part of the beltlike material (A') are subjected to bending 8 in the direction of the travel of the beltlike material (A') as shown in FIG. 4. When the bending 8 reaches a maximum, the beltlike material (A') slips on the bent projections 3 thereby permitting said bent projections 3 to be restored to the original state. Thus, the projections 3 act as the brakes relative to the beltlike material (A') thereby enabling each strip of the cut beltlike material (A') to be wound on the winding spindle 4 without slack.

If the beltlike material travel adjusting mechanism 5 consists of conveyors 9, a greater number of projections to be brought into contact with the beltlike material (A') can be provided thereon thereby making it possible to adjust the speed of the beltlike material (A') with greater effect.

Needless to mention, the beltlike material (A') may be adapted to slide on the surface of a table or the like by providing a conveyor 9 on one face of the beltlike material (A') without providing another conveyor 9 on the other face of the beltlike material (A').

As heretofore described, the use of the apparatus according to the invention makes it possible to wind cut beltlike material with efficiency and obtain a uniform winding of the cut beltlike material without a slack. Since the wound roll obtained by the use of the apparatus of the invention is free from slack, it is convenient to transport and store and protected from damage in actual use. Thus the wound roll obtained by using the apparatus has greater commercial value.

What is claimed is:

1. In a cut beltlike material winding apparatus having a take-up winding spindle, a multiplicity of parallel cutters for cutting beltlike material with a longitudinal travel zone therebetween, and, a beltlike material travel adjusting mechanism provided in said travel zone intermediate to said cutters and take-up winding spindle, the improvement therein comprising of said travel adjusting mechanism including rolling conveyor means with projections so disposed thereon as to be brought into contact with the cut beltlike material at right angles to the longitudinal travel zone.

2. A beltlike material travel adjusting mechanism as defined in claim 1, in which elasticity is imparted to the projections thereby enabling said projections to be bent and restored to the original state.

* * * * *